US006318261B1

(12) United States Patent
Koelsch

(10) Patent No.: US 6,318,261 B1
(45) Date of Patent: Nov. 20, 2001

(54) UNIVERSAL EDGE STRIP ASSEMBLY AND CARRIER SHEET ASSEMBLY

(75) Inventor: Kevin W. Koelsch, Toledo, OH (US)

(73) Assignee: Dynamic Dies, Inc., Holland, OH (US)

( * ) Notice: Subject to any disclaimer, the term of this patent is extended or adjusted under 35 U.S.C. 154(b) by 0 days.

(21) Appl. No.: 09/477,903

(22) Filed: Jan. 5, 2000

(51) Int. Cl.[7] ..... B41F 27/06
(52) U.S. Cl. ..... 101/378; 101/415.1; 101/383
(58) Field of Search ..... 101/382.1, 383, 101/384, 385, 386, 387, 388, 389, 378, 415.1, 408, 485, 486

(56) References Cited

U.S. PATENT DOCUMENTS

| | | | | |
|---|---|---|---|---|
| 1,996,582 | * | 4/1935 | Marchev | 101/415.1 |
| 3,295,443 | * | 1/1967 | Devon | 101/415.1 |
| 3,387,559 | | 6/1968 | Horner | 101/378 |
| 3,675,573 | | 7/1972 | Hawks | 101/378 |
| 3,946,670 | | 3/1976 | Cerny et al. | 101/378 |
| 4,090,444 | | 5/1978 | Stearns | 101/415.1 |
| 4,932,324 | | 6/1990 | Pinkston et al. | 101/415.1 |
| 5,127,327 | | 7/1992 | Philpot | 101/378 |
| 5,410,964 | | 5/1995 | Koelsch | 101/378 |
| 5,562,039 | * | 10/1996 | Fox et al. | 101/378 |

* cited by examiner

*Primary Examiner*—Leslie J. Grohusky
(74) *Attorney, Agent, or Firm*—Brinks Hofer Gilson Lione

(57) ABSTRACT

A universal edge strip is secured to both leading and trailing edges of a flexographic carrier sheet. A universal edge strip assembly includes the universal edge strip and a retaining clip. The universal edge strip includes a first pair of parallel walls connected to a center web which define a first deep slot or channel. The universal edge strip also includes a second pair of walls connected to the same center web which defines a second J-shaped shallow slot or channel. The first slot receives the carrier sheet which is secured to the universal edge strip by conventional means. One of the walls adjacent the second shallow slot includes a projection or J-shape which defines a throat adjacent the opposite wall. A U-shaped retaining clip is received within the second shallow slot in the universal edge strip at one end of the carrier sheet and is hooked to an undercut lip on the flexographic printing cylinder. As noted, both leading and trailing edges of the carrier sheet include a universal edge strip. Adjacent each edge strip is a plurality of slots. A plurality of elastic straps disposed in the slots secure the trailing edge of the carrier sheet to the cylinder.

17 Claims, 4 Drawing Sheets

42
46
40
36
44
38
48
24
50
32
94
28
60

UNIVERSAL EDGE STRIP ASSEMBLY AND CARRIER SHEET ASSEMBLY

BACKGROUND OF THE INVENTION

The invention relates generally to devices for providing accurate and secure mounting of a flexographic carrier sheet to a printing cylinder and more specifically to a universal edge strip assembly for securing an end of a printing plate carrier sheet to a printing cylinder.

Flexographic printing, also known as flexography or aniline printing, is a generally preferred printing process for large areas such as containers and cardboard cartons, point of purchase displays and the like. Flexographic printing is relief, i.e., direct, printing utilizing large plates fastened to a rotating cylinder. It is capable of producing an image with exceptional clarity and contrast. A single inking roller supplied with aniline ink from rollers in the ink fountain provides ink to raised, image forming printing plates disposed on the rotating cylinder which print directly upon the product. The carrier sheet or mounting material which carries the printing plate or plates may be several inches on each side or several feet. The carrier sheet is mounted to the printing cylinder at one edge by cooperation between a lip on the lead edge of the carrier sheet and a complementarily configured channel and undercut lip on the cylinder. The opposite edge of the carrier sheet is secured to the printing cylinder by one, or typically a plurality of, elastic straps which retain the carrier sheet upon the printing cylinder and properly tension it.

Since the elastic mounting straps merely provide tension to the carrier sheet to retain it upon the printing cylinder, it is apparent that the location and the registration of the carrier sheet and thus of the printing plate disposed thereon is almost exclusively the result of cooperation between the lead edge strip of the carrier sheet and the complementary lip on the printing cylinder. Since the printing cylinder is most generally fabricated of metal, it may be considered dimensionally stable and may thus be virtually ruled out as a source of variability and error when installing and utilizing flexographic printing plates. However, since the carrier sheet and its mounting edge are relatively lightweight, correct mounting and stability are concerns with regard to same. Accordingly, significant attention has been directed to the mounting and components of carrier sheets and their details.

SUMMARY OF THE INVENTION

A universal edge strip assembly for a flexographic carrier sheet includes a universal edge strip and a retaining clip. The universal edge strip is secured to both leading and trailing edges of the flexographic carrier sheet. The universal edge strip includes a first pair of parallel walls connected to a center web which define a first deep slot or channel. The universal edge strip also includes a second pair of parallel walls connected to the same center web which defines a second shallow slot or channel. The first slot receives the carrier sheet which is secured to the universal edge strip by conventional means. One of the walls adjacent the second shallow slot includes a projection or J-shape which defines a throat adjacent the opposite wall. A U-shaped retaining clip is received within the second shallow slot in the universal edge strip at one end of the carrier sheet and is hooked to the undercut lip of a flexographic printing cylinder. As noted, both leading and trailing edges of the carrier sheet include a universal edge strip. Formed in the carrier sheet adjacent each edge strip is a plurality of slots. A plurality of elastic straps disposed in the slots secure the trailing edge of the carrier sheet to the cylinder in tension.

The universal edge strip assembly is preferably transparent as this facilitates mounting of the universal edge strip assembly and carrier sheet upon a printing cylinder. The universal edge strip assembly is preferably extruded polyvinyl chloride (PVC). The edge strip may be utilized in any application requiring a secure, engageable lip disposed along an edge of diverse sheet material.

Thus it is an object of the present invention to provide an engageable strip for securement to an edge of sheet material.

It is a further object of the present invention to provide a novel universal edge structure for a carrier sheet for flexographic printing.

It is a still further object of the present invention to provide a universal edge strip assembly which includes a pair of parallel walls to which a carrier sheet may be secured.

It is a still further object of the present invention to provide a universal edge strip assembly with improved strength and rigidity which facilitates positive securement of a carrier sheet to a flexographic printing cylinder.

It is a still further object of the present invention to provide a universal edge strip assembly which is transparent and thus facilitates proper disposition of an associated carrier sheet upon a flexographic printing cylinder.

It is a still further object of the present invention to provide a universal edge strip which may be mounted to both the leading and trailing edges of a carrier sheet such that the carrier sheet may be reversibly mounted upon a flexographic printing cylinder.

It is a still further object of the present invention to provide a universal edge strip which, when mounted to trailing edge of a carrier sheet, does not interfere with the flexographic printing process.

Further objects and advantages of the present invention will become apparent by reference to the following description of the preferred embodiment and appended drawings wherein like reference numbers refer to the same component element or feature.

DESCRIPTION OF THE PREFERRED AND ALTERNATE EMBODIMENTS

Figure 1:
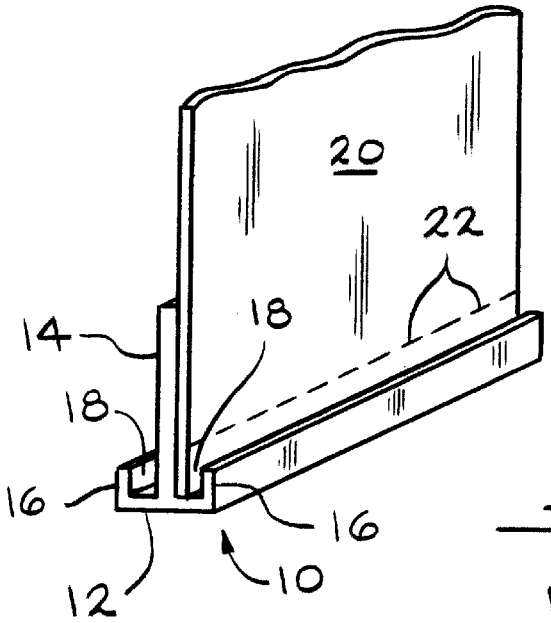
FIG. 1 PRIOR ART
FIG. 1 is a perspective view of a prior art lead edge strip attached to a carrier sheet.

Referring to FIG. 1, a prior art lead edge strip is illustrated and generally designated by the reference number 10. The prior art lead edge strip 10 may be conveniently described as a "T" with serifs which is inverted in the illustration. The prior art lead edge strip 10 is symmetrical and defines a bottom portion 12 which is integrally formed with a centrally disposed web 14 which is perpendicular to the bottom portion 12. Disposed parallel to the central web 14 and equally spaced therefrom are a pair of symmetrical ears 16. Between each of the ears 16 and the central web 14 is a channel 18 having a width greater than the thickness of a carrier sheet 20. The carrier sheet 20 is secured to the central web 14 by stitching or staples 22. The prior art lead edge strip 10 is an extrusion of opaque plastic material.

Figure 2:
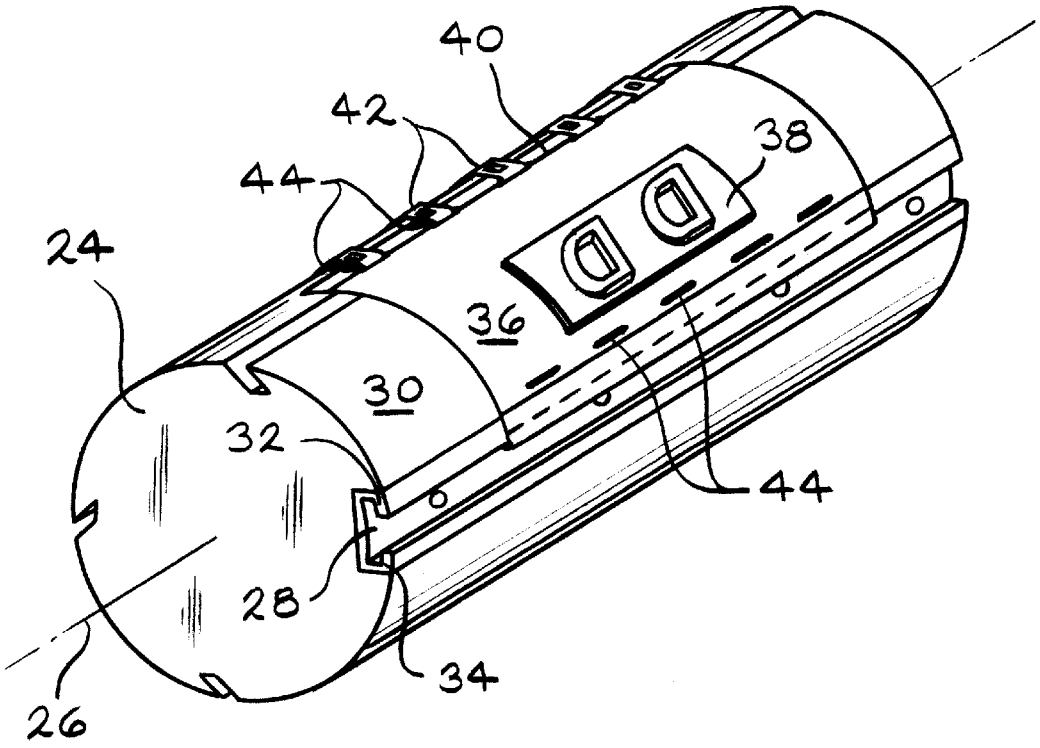
FIG. 2 is a diagrammatic, perspective view of a flexographic printing cylinder having a carrier sheet secured thereto by a universal edge strip assembly according to the present invention.
Figure 3:
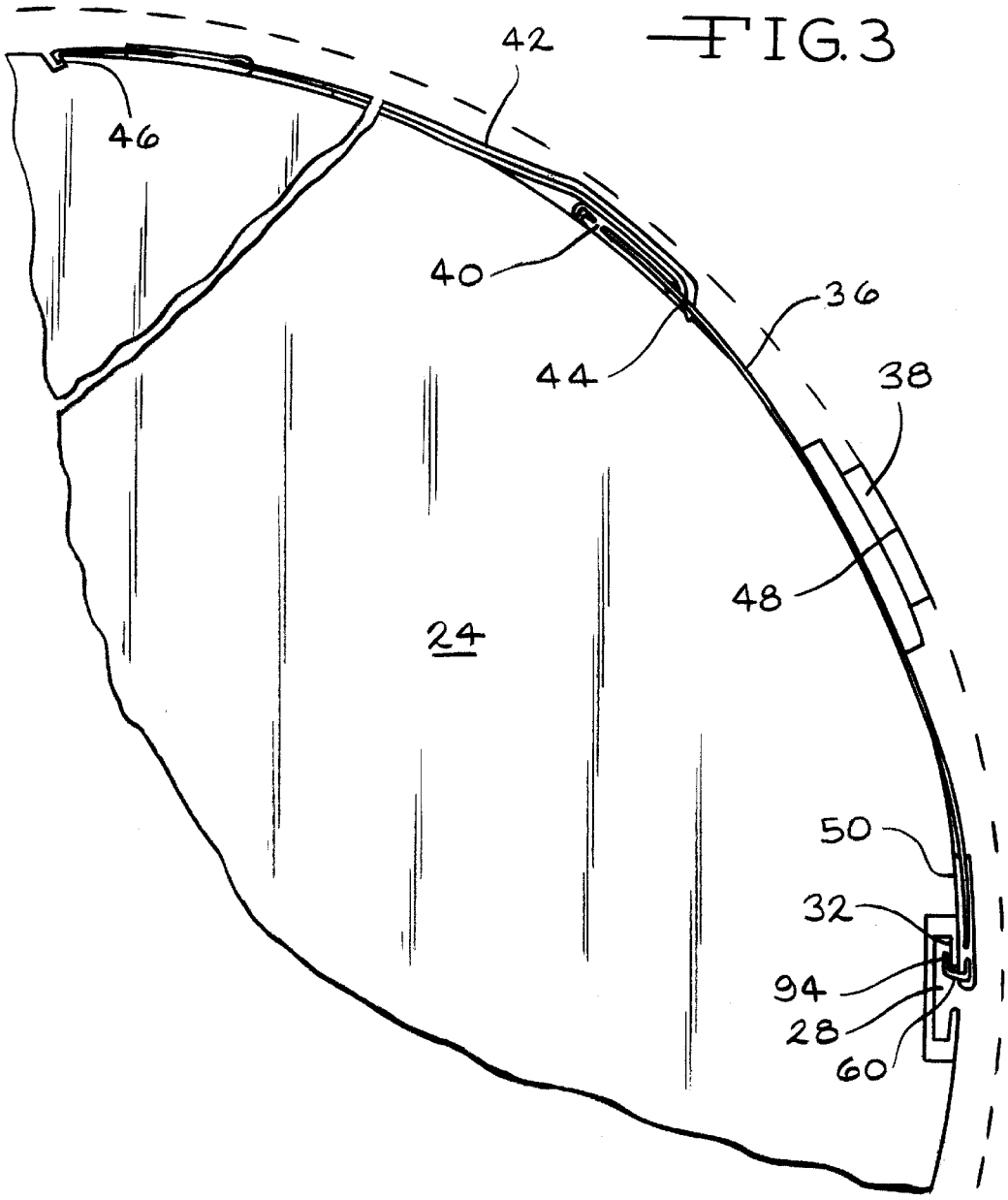
FIG. 3 is a diagrammatic end view of a flexographic printing cylinder having a carrier sheet secured thereto by a universal edge strip assembly according to the present invention.

Referring now to FIGS. 2 and 3, a flexographic printing cylinder 24 is diagrammatically illustrated. The printing cylinder 24 is disposed for clockwise rotation about a center axis 26 when viewed from the left end as illustrated in FIG. 2. The flexographic printing cylinder 24 includes a C-shaped kerf or channel 28 which extends generally across its full width. One wall of the channel 28 and an outer surface 30 of the printing cylinder 24 define a first substantially undercut lip 32. The channel 28 also defines a second, opposed undercut lip 34 spaced from and disposed parallel to the first undercut lip 32.

Disposed about and conforming to the outer surface 30 of the printing cylinder 24 is a flexographic printing carrier sheet 36. The carrier sheet 36 includes a printing plate 38 which is illustrative and representative of any and all types of text, diagrams, drawings and pictures, for example, which may be disposed upon and attached to the carrier sheet 36. The trailing edge of the carrier sheet 36 may be secured to the printing cylinder 24 by a plurality of elastic straps 42 which extend from and are secured to the carrier sheet 36 in a plurality of slots 44 located adjacent a first universal edge strip 40. The opposite ends of the elastic straps 42 are attached to the printing cylinder 24 by suitable flat hooks 46 and engage slots in the printing cylinder 24. At the opposite (leading) edge of the carrier sheet 36 is a second universal edge strip 50. It will be appreciated that the first universal edge strip 40 and the second universal edge strip 50 are identical in construction and configuration; the sole difference between them being their disposition at opposite edges of the carrier sheet 36.

As especially well illustrated in the elastic straps 42 are secured to the printing cylinder 24 by flat hooks 46 as noted. The elastic straps 42 extend along the surface of the printing cylinder 24 and over the first universal edge strip 40, thereby holding it against the surface of the printing cylinder 24. The elastic straps 42 engage the slots 44 and are secured thereto. Nowhere do the outer surfaces of the elastic straps 42 extend into or interfere with the effective print radius 48 of the printing plate 38. The carrier sheet 36 is held to the surface of the printing cylinder 24 by the tension supplied by the elastic straps 42.

Disposed at the opposite (leading) end of the carrier sheet 36, is the second universal edge strip 50. Secured to the second universal edge strip 50, is a retaining clip 60. The retaining clip 60 engages the first undercut lip 32 of the C-shaped channel 28. When properly engaged, the retaining clip 60 secures the second universal edge strip 50 to the printing cylinder 24.

Figure 4:
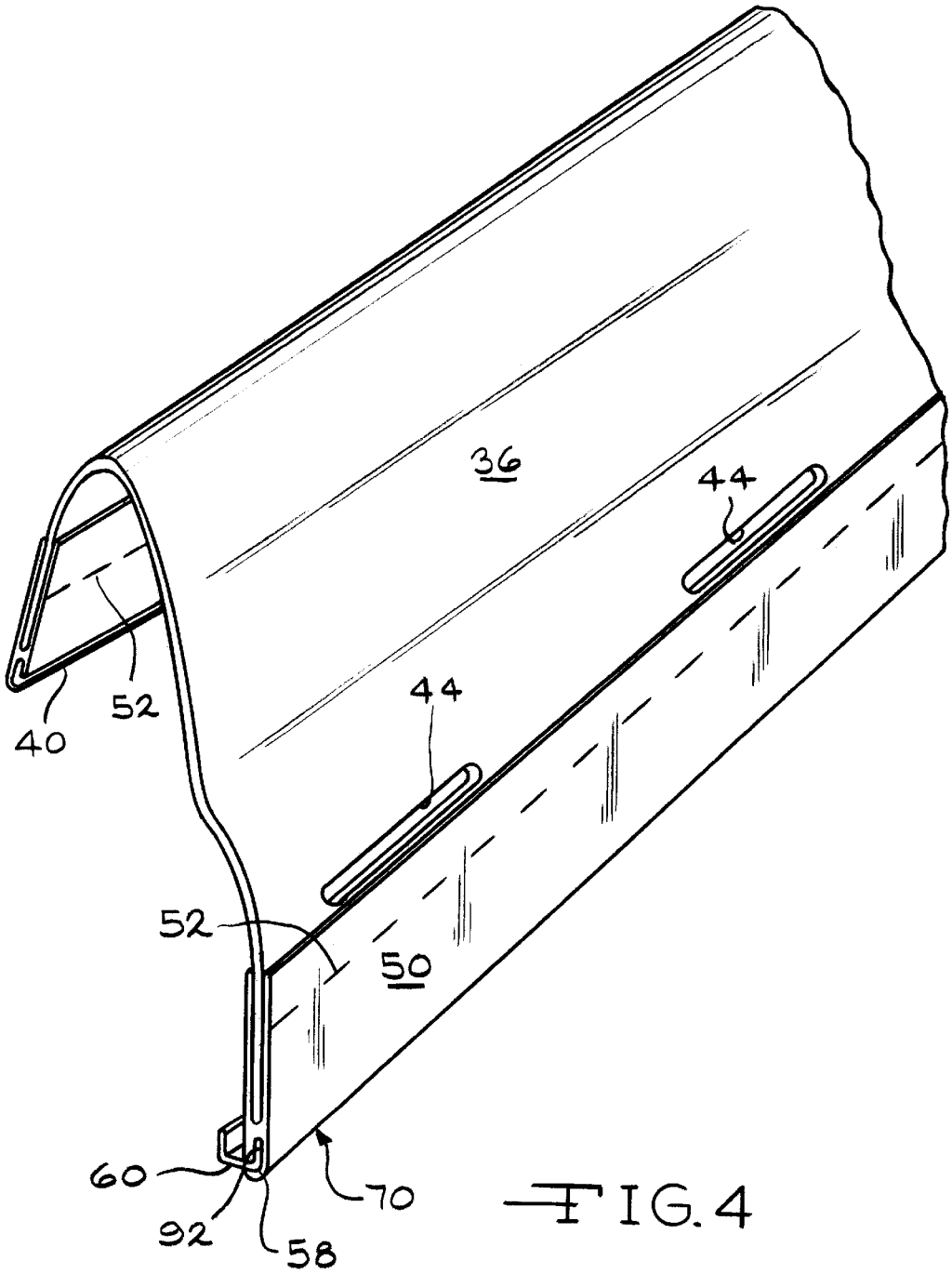
FIG. 4 is a perspective view of a flexographic carrier sheet having a universal edge strip according to the present invention secured at each end.

Referring to FIG. 4, the carrier sheet 36 is shown with the universal edge strips 40 and 50 and the retaining clip 60 installed. A universal edge strip assembly 70 is shown including the universal edge strip 50 and the retaining clip 60 disposed therein. The universal edge strips 40 and 50 extend essentially the full width of the carrier sheet 36. Likewise, the retaining clip 60 extends essentially the full width of the second universal edge strip 50. Both universal edge strips 40 and 50 are secured to the carrier sheet 36 by stitching or staples 52 or other means such as an adhesive or autogenous bonding achieved by the application of RF or IR radiation, heat or ultrasonic energy.

Figure 5:
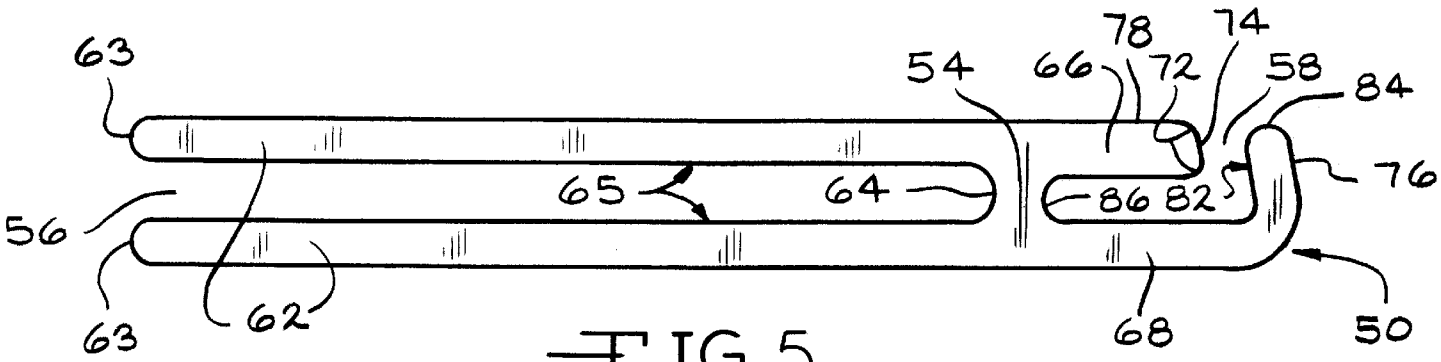
FIG. 5 is a greatly enlarged, end elevational view of a universal edge strip according to the present invention.

Referring to FIG. 5, the second universal edge strip 50 according to the present invention is shown. It will be appreciated that, as noted, the first universal edge strip 40 and the second universal edge strip 50 are, but for their opposed, mirror image disposition at opposite ends of the carrier sheet 36, identical. Thus, only the second universal edge strip 50 will be described. The second universal edge strip 50 defines an asymmetric structure having a central web 54 which separates a first deep slot or channel 56 from a second shallow slot or channel 58. A first pair of parallel walls 62 define the first deep slot 56 which receives the carrier sheet 36. The first pair of parallel walls 62 are spaced from each other a distance substantially equal to or just slightly greater than the thickness of the carrier sheet 36. Each of the parallel walls 62 define radiused, semi-circular terminal portions 63 and interior surfaces 65. The bottom of the first deep slot 56, that is, that portion immediately adjacent the central web 54, defines a curved, semi-circular surface 64. The semi-circular surface 64 serves to reduce stress concentrations and distributes forces acting on the universal edge strip 50 thereby inhibiting cracking and improving its service life. The carrier sheet 36 is received within the first slot 56 and is secured to the parallel walls 62 of the universal edge strip 50 as shown in FIG. 4 and as noted above. The lengths of the parallel walls 62 are preferably similar as illustrated. Alternatively, they may have different lengths as shown in U.S. Pat. No. 5,410,964, incorporated herein by reference. As illustrated in FIG. 4 of the U.S. Pat. No. 5,410,964, unequal wall lengths provide a flat surface adjacent the end of the shorter wall which advantageously acts as a guide and facilitates insertion of the carrier sheet into the slot.

Returning to the present invention, the second, J-shaped shallow slot or channel 58 extends from the side of the central web 54 opposite the first deep slot or channel 56. A shorter, thicker wall 66 extends from the central web 54 and terminates at radiused corners 72 and an oblique surface 74. A longer, thinner wall 68 extends from the opposite end of the central web 54 parallel to the shorter, thicker wall 66. At the end of the longer, thinner wall 68, is J-shaped and includes oblique projection 76 extending toward the shorter, thicker wall 66. The oblique projection 76 does not extend beyond the plane defined by an outer surface 78 of the shorter, thicker wall 66. The projection 76 defines an overhanging hook or lip surface 82 at a right angle or a large acute angle with respect to the longer thinner wall 68. The inside lip surface 82 is parallel to the oblique surface 74. The projection 76 terminates at a rounded end 84.

The second J-shaped shallow slot 58 is defined by the shorter, thicker wall 66, the longer, thinner wall 68, and the projection 76. The radiused corners 72 and the rounded end 84 define an entrance or mouth of the shallow J-shaped slot 58. The shallow slot 58 terminates at a semi-circular surface 86 of the central web 54. The shallow slot 58 is generally complementary to and receives the U-shaped retaining clip 60.

Figure 6:
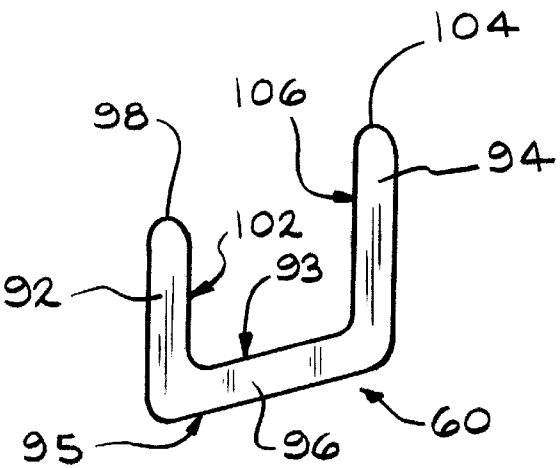
FIG. 6 is a greatly enlarged, end elevational view of a preferred embodiment retaining clip for a universal edge strip assembly according to the present invention.

Referring now to FIG. 6, a retaining clip 60 is shown from an end. The retaining clip 60 is a skewed U-shaped channel with first and second parallel sidewalls, 92 and 94, extending in the same direction from the ends of an oblique center section 96. The center section 96 defines an inner surface 93 and an outer surface 95. The first sidewall 92 extends away from one end of the center section 96 and forms an acute angle with the center section 96. The first sidewall 92 terminates at semi-circular surface 98 and has an inner surface 102.

On the opposite end of the center section 96, the second sidewall 94 extends from the center section 96 and in the same direction. The second sidewall 94, which is preferably slightly longer than the first sidewall 92, forms an obtuse angle with respect to the center section 96 and terminates at a semi-circular surface 104. An inner surface 106 of the second parallel sidewall 94 abuts the first undercut lip 32 of the printing cylinder 24 upon installation. The angle formed between the first sidewall 92 and the center section 96 is approximately the same angle as that formed between the longer, thinner wall 68 and the projection 76 of the universal edge strip 50. Preferably, both parallel sidewalls 92 and 94 and the center section 96 have the same thickness and are joined with radiused inner and outer corners where the sidewalls 92 and 94 extend from the center section 96 to reduce bending stresses when loaded.

When assembled as shown in FIG. 4, the first sidewall 92 of the retaining clip 60 is inserted into the shallow slot 58 of the second universal edge strip 50. When properly positioned, the semi-circular surface 98 of the first sidewall 92 abuts the semi-circular surface 86 at the end of the shallow slot 58. The projection 76 flexes outward and away from radiused corners 72 during assembly.

As shown in FIG. 3, upon final assembly of the carrier sheet 36 to the printing cylinder 24, the second sidewall 94 of the retaining clip 60 is inserted into the C-shaped channel 28 of the printing cylinder 24. The second sidewall 94 is hooked under the first undercut lip 32 of the channel 28 such that the inner surface 106 of the second sidewall 94 abuts the first undercut lip 32.

It will be appreciated that the two components of the universal edge strip assembly 70 cooperate to restrict the motion of the carrier sheet 36 in the direction of the tension force applied by its elastic straps 42. When properly installed, the elastic straps 42 apply a tensioning force to the carrier sheet 36. This tensioning force is resisted at the lead edge of the carrier sheet 36 by the securement means 52. The securement means 52 secures the carrier sheet 36 to at least one surface 65. The surface 65 of the universal edge strip 50 is connected to the inside surface 82 through the parallel wall 62, central web 54, longer thinner wall 68, and projection 76. Any combination of structural elements may be used to connect surfaces 65 and 82. The important factor is the surface 82 must oppose any motion in the direction of the tensioning force. Abutted at surface 82 is the outer surface 95 of the retaining clip 60. The surface 95 restricts the motion of the surface 82 in the direction of the tensioning force. The outer surface 95 is connected to the inner surface 93 through the center section 96. The inner surface 93 abuts the corner of the first undercut lip 32 to restrict motion of the retainer clip 60 in the direction of the tensioning force. Alternatively, the outer surface 95 is connected to the semi-circular surface 104 through the center section 96 and the second parallel panel 94. The semicircular surface 104 restricts the motion of the retaining clip in the direction of the tensioning force when it abuts the end of the first undercut lip 32. Any structural element combination may be used to connect the surfaces, provided the orientation and positions of the surfaces remain essentially constant.

Figure 7:
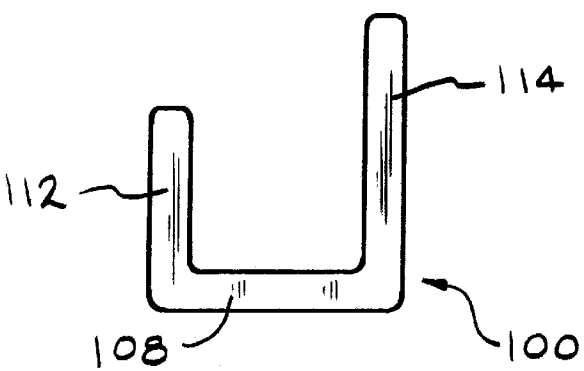
FIG. 7 is a greatly enlarged, end elevational view of a first alternate embodiment retaining clip for a universal edge strip assembly according to the present invention.

Referring now to FIG. 7, a first alternate embodiment retaining clip 100 is illustrated. The first alternate embodiment retaining clip 100 is similar in all respects to the preferred embodiment retaining clip 60 with the exception of the orientation of the oblique center section 96. In the alternate embodiment retaining clip 100, the center section 108 forms essentially right angles with respect to a first parallel sidewall 112 and a second parallel sidewall 114. In a similar manner, the projection 76 on the first alternate embodiment of the universal edge strip 50 extends away from the longer thinner wall 68 at a right angle (not shown).

Preferably, the universal edge strip 50 and the retaining clip 60 are fabricated by extrusion from a transparent, rugged plastic material such as virgin polyvinyl chloride (PVC). Alternatively, any suitable metal may be used for either component. While either part may be fabricated of an opaque material, transparent materials are preferable since they have the distinct advantage of permitting visual checks of the proper mounting and registration of the retaining clip 60 on the first undercut lip 32 and thus proper mounting of the carrier sheet 36 and the printing plate 38 on the printing cylinder 24. As extrusions, it will be appreciated that the universal edge strip 50 and the retaining clip 60 may be produced in continuous lengths which may be cut to any convenient length for shipment and further trimmed or cut to match the width of the carrier sheet 36 to which they are secured.

While described herein with general reference to carrier sheets for flexographic printing, it should be appreciated that the universal edge strip assembly 70 of the present invention will find broad application in those areas requiring a secure engageable lip disposed along an edge of sheet material to facilitate mounting or securement of such material to associated equipment or complementary structure.

The foregoing disclosure is the best mode devised by the inventor for practicing this invention. It is apparent, however, that apparatus incorporating modifications and variations will be obvious to one skilled in the art of printing. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A universal edge strip assembly for disposition upon a sheet comprising, in combination;

a universal edge strip having, a central web, a first pair of parallel sidewalls extending from said central web, said parallel walls defining a first slot for receiving the sheet, and a second pair of sidewalls extending from said central web in a direction generally opposite to said first pair of sidewalls and defining a second slot, one of said second pair of sidewalls having an overhanging lip defining a throat with another of said second pair of sidewalls; and a U-shaped retaining member having a center section and two sidewalls;

wherein said retaining member is disposed within said second slot of said universal edge strip.

2. The universal edge strip assembly of claim 1 wherein said center section of said retaining member is disposed at an oblique angle to said two sidewalls.

3. The universal edge strip assembly of claim 2 wherein one of said two sidewalls is disposed at an acute angle to said center section.

4. The universal edge strip assembly of claim 1 wherein said lip is disposed at an acute angle with respect to said one of said second pair of sidewalls.

5. The universal edge strip assembly of claim 1 wherein said first slot defines a width at least equal to the sheet.

6. The universal edge strip assembly of claim 1 wherein said another of said second pair of sidewalls is thicker than said one of said second pair of sidewalls.

7. The universal edge strip assembly of claim 1 which is fabricated of transparent polyvinyl chloride.

8. The universal edge strip assembly of claim 1 wherein said center section of said retaining member is disposed at a right angle to said two sidewalls.

9. A universal edge strip assembly for disposition upon a sheet having a leading edge and a trailing edge, comprising, in combination;

a central web, a first pair of parallel sidewalls extending from said central web, said parallel walls defining a first slot for receiving the sheet, and a second pair of sidewalls extending from said central web in a direction generally opposite to said first pair of sidewalls and defining a second slot, one of said second pair of sidewalls having an overhanging lip defining a throat with another of said second pair of sidewalls.

10. The universal edge strip assembly of claim 9 further including a U-shaped retaining member disposed in said throat.

11. The universal edge strip assembly of claim 10 wherein said retaining member includes two walls and an obliquely disposed center section.

12. The universal edge strip assembly of claim 9 wherein said first slot defines a width at least equal to the sheet.

13. The universal edge strip assembly of claim 9 wherein said another of said second pair of sidewalls is thicker than said one of said second pair of sidewalls.

14. The universal edge strip assembly of claim 9 which is fabricated of transparent polyvinyl chloride.

15. A carrier sheet assembly comprising, in combination;

a carrier sheet for disposition on a printing cylinder, said carrier sheet having a leading edge and a trailing edge;

an edge strip secured to each of said leading edge and said trailing edge having, a central web having a pair of opposed regions, a first pair of parallel walls extending from one of said pair of regions, said parallel walls defining a first channel for receiving said carrier sheet, and a second pair of walls extending from another of said pair of regions and defining a second channel, one of said second pair of walls having an overhanging projection defining a throat with said other of said second pair of walls; and a retaining clip having a center section and two end walls disposed in said throat of said second pair of walls of one of said edge strips.

16. The carrier sheet assembly of claim 15 wherein said carrier sheet is secured to said first pair of parallel walls by staples.

17. The carrier sheet assembly of claim 15 wherein said edge strips and said retaining clip are both transparent polyvinyl chloride.

* * * * *